United States Patent [19]

Hanchett, Jr. et al.

[11] Patent Number: 4,595,220

[45] Date of Patent: Jun. 17, 1986

[54] DEAD BOLT SENSING AND STRIKE CLOSING MECHANISM

[75] Inventors: Leland J. Hanchett, Jr., Phoenix; Mark A. Lawrence, Mesa, both of Ariz.

[73] Assignee: Hanchett Entry Systems, Inc., Phoenix, Ariz.

[21] Appl. No.: 583,756

[22] Filed: Feb. 27, 1984

[51] Int. Cl.[4] ..... E05B 15/02

[52] U.S. Cl. ..... 292/341.17; 292/341.16

[58] Field of Search ..... 292/341.15, 341.16, 292/341.17; 70/131, 136

[56] References Cited

U.S. PATENT DOCUMENTS

| | | | |
|---|---|---|---|
| 277,628 | 5/1883 | Sullivan | 292/341.16 |
| 352,154 | 11/1886 | Rousseau | 292/341.16 |
| 3,211,850 | 10/1965 | Toepfer | 200/61.64 |
| 3,638,984 | 2/1972 | Davidson | 292/341.16 |
| 3,640,560 | 2/1972 | Zawadski et al. | 292/341.16 |
| 3,796,452 | 3/1974 | Foster et al. | 292/341.16 |
| 3,861,727 | 1/1975 | Froerup et al. | 292/341.16 |
| 3,910,617 | 10/1975 | Scalza et al. | 292/341.16 |
| 4,017,107 | 4/1977 | Hanchett | 292/341.16 |
| 4,026,589 | 5/1977 | Hanchett, Jr. | 292/341.16 |
| 4,083,590 | 4/1978 | Folger | 292/92 |

FOREIGN PATENT DOCUMENTS

| | | | |
|---|---|---|---|
| 46394 | 3/1889 | Fed. Rep. of Germany | 292/341.16 |

*Primary Examiner*—Robert L. Wolfe
*Assistant Examiner*—Russell W. Illich
*Attorney, Agent, or Firm*—Richards, Harris, Medlock & Andrews

[57] ABSTRACT

A door lock (10) includes a strike case (18) adapted to receive a dead bolt (14). A rotatable keeper (20) is rotatable between an open and closed position for opening and closing the strike case (18). An abutment member (30) is connected to the rotatable keeper (20) and is selectively rotatable with the rotatable keeper (20). A sensing arm (34) is connected to the strike case (18) for sensing the presence of the dead bolt (14) in the strike case (18). The sensing arm (34) selectively disengages the abutment member (30) for allowing the abutment member (30) to rotate with the rotatable keeper (20) if the dead bolt (14) is detected within the strike case (18).

7 Claims, 7 Drawing Figures

DEAD BOLT SENSING AND STRIKE CLOSING MECHANISM

TECHNICAL FIELD

This invention relates to door locking mechanisms, and more particularly to a dead bolt sensing and strike closing device for a door lock.

BACKGROUND OF THE INVENTION

In various types of door locking devices, it is advantageous to differentiate between a situation where a dead bolt is projected into the strike opening and the case where a latch bolt is projected into the strike opening. In a mortise lock set wherein both a dead bolt and a latch bolt are utilized, the bolts are engaged by a keeper of the electric strike. If the strike becomes engaged, the keeper is released and the door may be pushed open. Upon returning the door to the locked position, it is necessary for the keeper to remain in the open position and then close up over the extended dead bolt to recapture the dead bolt prior to closing of the door. On the other hand, if the latch bolt was extended into the strike cavity, the keeper can return to the closed position automatically so that the returning latch bolt rides over the bevel of the keeper to thereby reengage the keeper.

It is therefore necessary to maintain the keeper open if the dead bolt were extended into the strike cavity so that the dead bolt can reenter the strike cavity prior to the keeper closing. If the dead bolt were extended and the keeper closed while the door was open, upon trying to reclose the door, the dead bolt would hit the top of the keeper and the door would not lock. Similarly, if the keeper were allowed to stay open when only the latch bolt was extended, the latch bolt could not pull the keeper into the locked position due to the bevel of the latch bolt as the latch bolt returned to the strike cavity. This situation would again prevent the door from locking.

A need has thus arisen for a simple and reliable device for sensing the presence of a dead bolt in a strike cavity to ensure that the keeper tracks the position of the dead bolt.

SUMMARY OF THE INVENTION

In accordance with the present invention, a door locking mechanism is provided for detecting the presence or absence of a projected dead bolt and for controlling the positioning of a strike case keeper.

In accordance with the present invention, a door locking mechanism includes a strike case adapted to receive a dead bolt. A pivotable keeper is provided which is selectively rotatable between an open and a closed position for opening and closing the strike case. An abutment member is connected to the keeper and is selectively rotatable with the keeper. A sensing device is connected to the strike case for sensing the presence of the dead bolt in the strike case and for selectively engaging the abutment member for allowing the abutment member to rotate with the keeper when the dead bolt is detected in the strike case.

BRIEF DESCRIPTION OF THE DRAWINGS

For a more complete understanding of the present invention and for further advantages thereof, reference is now made to the following Detailed Description taken in conjunction with the accompanying Drawings in which.

DETAILED DESCRIPTION

Figure 1:
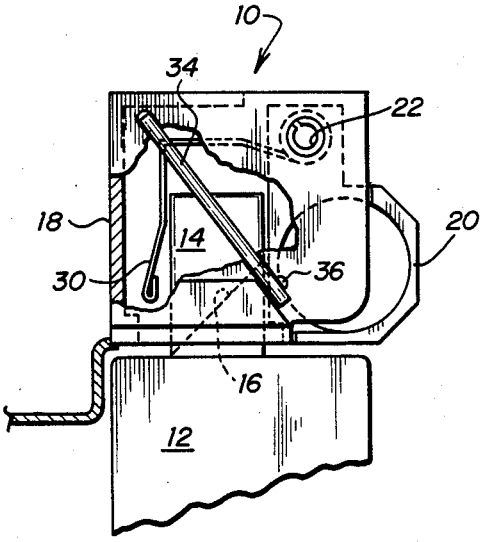
FIG. 1 is a top plan view of a lock with a keeper in the closed and latched position with both a dead bolt and latch bolt extended for use with the present invention.
Figure 2:
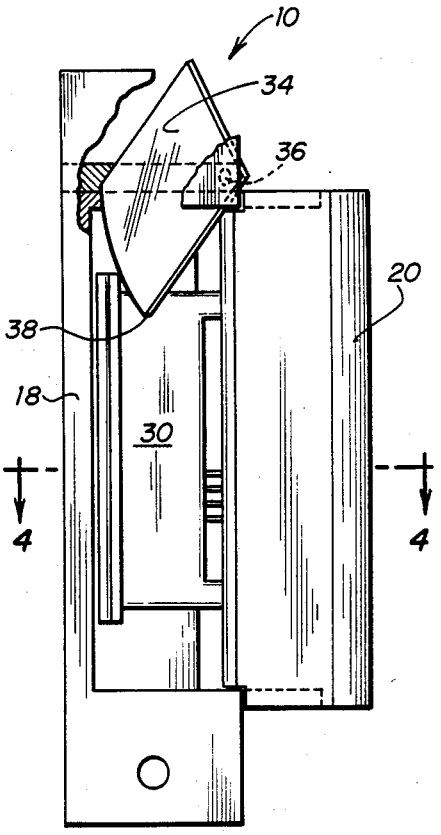
FIG. 2 is an elevational view, partially in section, of the lock illustrated in FIG. 1 with the dead bolt and latch bolt removed to illustrate the abutment member and sensing arm of the present invention.
Figure 3:
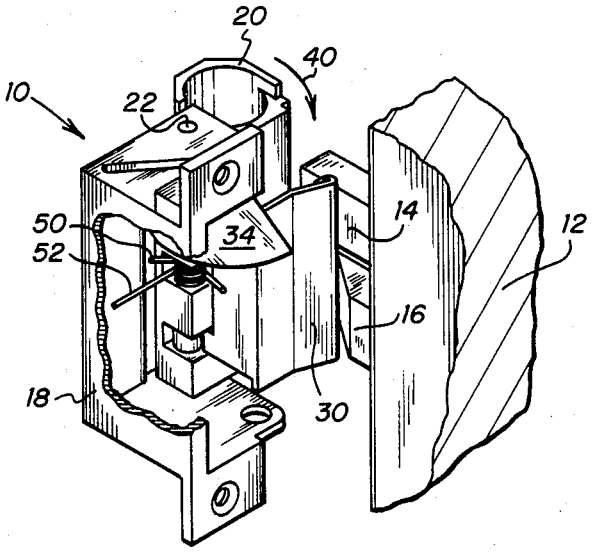
FIG. 3 is a perspective view of the lock of FIGS. 1 and 2 illustrating the present abutment member engaging the dead bolt.

Referring simultaneously to FIGS. 1, 2 and 3, a lock generally identified by the numeral 10 for use with the present invention is illustrated. Lock 10 is utilized with a door 12 having a dead bolt 14 and a latch bolt 16. Lock 10 includes a strike case 18 which is selectively opened and closed utilizing a rotatable keeper 20 which is rotatable from the closed position as illustrated in FIG. 1 to the open position as illustrated in FIG. 3 to allow door 12 to be opened. Rotatable keeper 20 is pivotable about a pair of pins 22 which mount rotatable keeper 20 to strike case 18.

Pivotally mounted within strike case 18 is an abutment member 30 which rotates from the retracted position as illustrated in FIG. 1 to an extended position as illustrated in FIG. 3 for contacting dead bolt 14.

An important aspect of the present invention is the use of a sensing arm 34 which is pivotable about a pin 36 mounted to strike case 18. Sensing arm 34 is pivotable to engage abutment member 30 when dead bolt 14 is retracted within door 12 to thereby prevent abutment member 30 from moving to the extended position of abutment member 30 as illustrated in FIG. 3. Sensing arm 34 further is rotatable to a position to be disengaged from abutment member 30 when dead bolt 14 is extended into strike case 18 to thereby allow abutment member 30 to rotate to the extended position as illustrated in FIG. 3. Sensing arm 34 descends at approximately a 45° angle from its pivot point at the upper front of strike case 18 to its interference point 38 (FIG. 2) with abutment member 30 at the bottom back of strike case 18. This configuration allows sensing arm 34 to be moved out of the path of abutment member 30 by abutment member 30 when door 12 is closed so that sensing arm 34 reengages abutment member 30 unless dead bolt 14 is projected into strike case 18.

Abutment member 30 is rotatable in the direction of rotatable keeper 20. As door 12 is closed, dead bolt 14 engages abutment member 30 and rotatable keeper 20 is caused to rotate in the direction of arrow 40 from the open position of FIG. 3 to the closed position of FIG. 1. It can be seen that since latch bolt 16 has a triangular configuration, latch bolt 16 is ineffective to engage abutment member 30.

Figure 4:
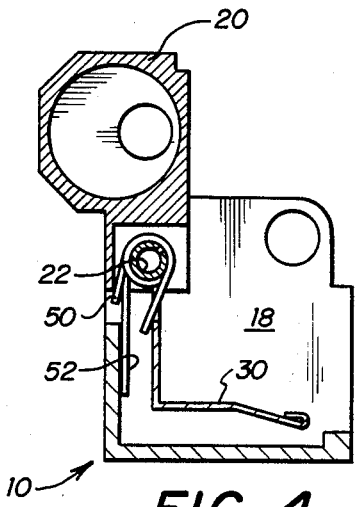
FIG. 4 is a sectional view taken generally along sectional lines 4—4 of FIG. 2 illustrating the abutment member of the present invention in the retracted position to cause the keeper to be spring loaded in the closed position.

Referring now to FIG. 4, abutment member 30 is illustrated in the retracted position wherein sensing arm 34 (FIG. 2) maintains abutment member 30 in the retracted position when dead bolt 14 is retracted within door 12, thereby preventing abutment member 30 from following the movement of rotatable keeper 20. With abutment member 30 in the retracted position, rotatable keeper 20 automatically returns to the closed position (FIG. 1) since rotatable keeper 20 is biased to return to the closed position by torsion springs 50 and 52. Torsion spring 50 serves to urge abutment member 30 toward rotatable keeper 20 while torsion spring 52 serves to urge rotatable keeper 20 toward abutment member 30. In the configuration illustrated in FIG. 4, torsion spring 52 is operative and therefore rotatable keeper 20 is biased toward the closed and locked position.

Figure 5:
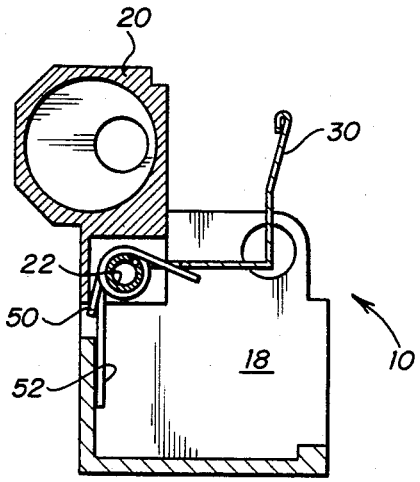
FIG. 5 is a sectional view taken generally along sectional lines 4—4 of FIG. 2 illustrating the abutment member in the extended position to engage the returning dead bolt.

Referring now to FIG. 5, abutment member 30 is illustrated in the extended position having been released by sensing arm 34 which has sensed the presence of an extended dead bolt 14. Abutment member 30 is forced outward toward rotatable keeper 20 by torsion springs 50 and 52. Rotatable keeper 20 and abutment member 30 are thus in a steady state condition being held by torsion spring 52.

Figure 6:
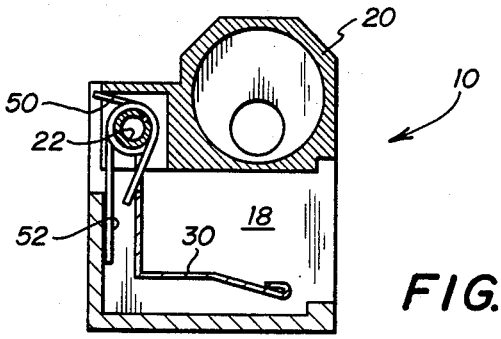
FIG. 6 is a sectional view taken generally along sectional lines 4—4 of FIG. 2 illustrating the keeper in the closed position.

FIG. 6 illustrates rotatable keeper 20 in the closed position. The rotation of abutment member 30 from the position illustrated in FIG. 5 is due to engagement of abutment member 30 by an extended dead bolt 14 as door 12 is closed. Engagement of dead bolt 14 with abutment member 30 causes rotation of rotatable keeper 20 from the position illustrated in FIG. 5 to the closed position illustrated in FIG. 6.

Figure 7:
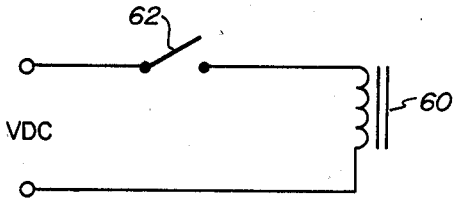
FIG. 7 is a schematic diagram illustrating a control circuit for a solenoid associated with the lock of FIG. 1.

Referring now to FIG. 7, a schematic diagram illustrates the connection of a strike solenoid 60 associated with lock 10 and a sensing switch 62. Sensing switch 62 is controlled by the position of sensing arm 34 to detect the presence or absence of dead bolt 14 within strike case 18. Sensing switch 62 can be operative to inhibit the opening of strike case 18 by deenergizing strike solenoid 60 when dead bolt 14 is extended within strike case 18. Alternatively, strike solenoid 60 may be energized when sensing arm 34 detects the presence of an extended dead bolt 14 within strike case 18. Strike solenoid 60 is connected to rotatable keeper 20 as illustrated in U.S. Pat. No. 4,026,589 which is incorporated herein by reference.

It therefore can be seen that the present invention provides for a dead bolt sensing device for sensing the presence of an extended dead bolt within a strike case. The presence of the dead bolt causes rotation of an abutment member for allowing the dead bolt to automatically close a keeper when the door is closed. The present invention further allows the keeper to be opened or closed when a dead bolt is sensed within a strike case.

Whereas the present invention has been described with respect to specific embodiments thereof, it will be understood that various changes and modifications will be suggested to one skilled in the art and it is intended to encompass such changes and modifications as fall within the scope of the appended claims.

We claim:

1. A mechanism for locking and releasing a door having a dead bolt, comprising:
   - a strike case adapted to receive the dead bolt;
   - a keeper pivotally mounted to said strike case for opening and closing said strike case;
   - an abutment member connected to said keeper and selectively pivotable with said keeper; and
   - means connected to said strike case for engaging said abutment member to prevent said abutment member from pivoting with said keeper when the dead bolt is retracted within the door, and for sensing the presence of the dead bolt in said strike case so as to disengage said abutment member and allow said abutment member to pivot with said keeper as the door is opened with the dead bolt extended.

2. The door locking and releasing mechanism of claim 1, further comprising means for biasing said engaging and sensing means in the direction to interfere with the pivotal movement of said abutment member.

3. The door locking and releasing mechanism of claim 1, further comprising means for biasing said abutment member for pivotal movement in unison with said keeper.

4. The door locking and releasing mechanism of claim 1, further comprising means connected to said engaging and sensing means for preventing pivotal movement of said keeper from the closed position to the open position when said engaging and sensing means detects the presence of the dead bolt in said strike case.

5. The door locking and releasing mechanism of claim 1, further comprising means connected to said engaging and sensing means for pivoting said keeper from the closed position to the open position when said engaging and sensing means detects the presence of the dead bolt in said strike case.

6. The door locking and releasing mechanism of claim 1 wherein said abutment member cooperates with the dead bolt to return said keeper to said closed position if the dead bolt engages said abutment member.

7. A mechanism for locking and releasing a door having a dead bolt, comprising:
   - a strike case adapted to receive the dead bolt;
   - a pivotable keeper selectively rotatable between an open and a closed position for opening and closing said strike case;
   - an abutment member connected to said keeper and selectively rotatable with said keeper and further cooperating with the dead bolt to return said keeper to said closed position if the dead bolt engages said abutment member;
   - means for biasing said abutment member to rotate in unison with said pivotable keeper;
   - sensing means connected to said strike case for sensing the presence of the dead bolt in said strike case and for selectively disengaging said abutment member for allowing said abutment member to rotate with said keeper to said open position only when said dead bolt is detected in said strike case;
   - means for biasing said sensing means in the direction of interfering with the rotation of said abutment member; and
   - means connected to said sensing means for controlling said pivotable keeper.

* * * * *